US005199717A

United States Patent [19]

Wimmer

[11] Patent Number: 5,199,717

[45] Date of Patent: Apr. 6, 1993

[54] LIGHT WEIGHT BOOMERANG TOY HAVING IMPROVED FLIGHT AND RETURN CHARACTERISTICS

[75] Inventor: Harold C. Wimmer, Vista, Calif.

[73] Assignee: John C. Jensen, Vista, Calif. ; a part interest

[21] Appl. No.: 926,160

[22] Filed: Aug. 5, 1992

[51] Int. Cl.[5] ..... A63B 65/08

[52] U.S. Cl. ..... 273/426

[58] Field of Search ..... 273/426, 424

[56] References Cited

U.S. PATENT DOCUMENTS

| | | | |
|---|---|---|---|
| 3,710,505 | 1/1973 | Linenfelser | 273/424 X |
| 3,881,729 | 5/1975 | Block et al. | 273/426 |
| 4,222,573 | 9/1980 | Adler | 273/426 |
| 4,337,950 | 7/1982 | Gidge | 273/426 |
| 4,421,320 | 12/1983 | Robson | 273/426 X |
| 4,452,461 | 6/1984 | O'Brien | 273/426 |
| 4,479,655 | 10/1984 | Adler | 273/426 X |
| 4,591,164 | 5/1986 | Blight | 273/426 X |
| 4,856,793 | 8/1989 | Hannifin | 273/426 |
| 4,934,713 | 6/1990 | Hunter | 273/426 X |
| 5,045,011 | 9/1991 | Lovik | 273/426 X |

FOREIGN PATENT DOCUMENTS

| | | | |
|---|---|---|---|
| 289489 | 8/1966 | Australia | 273/426 |
| 718215 | 11/1954 | United Kingdom | 273/426 |

*Primary Examiner*—Paul E. Shapiro
*Attorney, Agent, or Firm*—Frank D. Gilliam

[57] ABSTRACT

A light weight boomerang toy having several blades of unique configuration extending from a central hub. Each blade has a straight or uniformly curved leading edge and a scalloped trailing edge. The trailing edge of each blade decreases in thickness from a line having a specific relationship to the blade centerline to provide improved lift and flight characteristics. While the blades are ordinarily coplanar with the hub and each other, they can be bent or the boomerang dished if desired to modify flight characteristics. For improved safety, and to permit use of the boomerang indoors, it preferably is formed from a closed cell synthetic resin foam.

21 Claims, 2 Drawing Sheets

LIGHT WEIGHT BOOMERANG TOY HAVING IMPROVED FLIGHT AND RETURN CHARACTERISTICS

BACKGROUND OF THE INVENTION

This invention relates in general to boomerang-type flight toys and, more specifically to a multi-bladed boomerang toy having improved flight and return characteristics which is safe for use indoors.

The earliest boomerangs had a very broad V-shape, with two flat blades extending from a centerpoint. Those boomerangs were used primarily as an aboriginal hunting weapon which would fly in a flat circle while rapidly spinning, returning to the location of the thrower. The return characteristics were useful in retrieving the boomerang if the thrower missed the target. These boomerangs were large and heavy, with sharp edges, made from strong wood. The returning boomerang would be allowed to strike the ground, since attempting to catch it would be very dangerous.

A great number of boomerang toys have been developed over the years which attempt to retain the return flight capability while improving performance and allowing the boomerang to be safely caught. Many of these have multiple blades extending from a central hub, such as those described by O'Brien in U.S. Pat. No. 4,452,461, by Hunt in U.S. Pat. No. 4,772,030 and by Robson in U.S Pat. No. 4,421,320.

A variety of other flight devices, such as the popular "Frisbee" flying disk have also been developed. These devices do not act in the manner of a boomerang which is thrown in a generally circular path parallel to the ground over large distances and returns to the thrower. Instead, the flying disk type devices when simply thrown upwardly at an angle, generally into the wind, "slide" back down to the thrower.

Boomerang flight apparently results from a combination of gliding, gyroscopic action from the rotation and lift from the blades. A boomerang must be accurately constructed so that these combined effects produce the desired flight characteristics. Many hand made boomerangs fail to fly properly despite being apparent close copies of fully operative boomerangs. Most prior boomerangs are difficult or impossible to adjust and require considerable skill for proper flight. Adjustable boomerangs, such as is described by Liston in U.S. Pat. No. 3,565,434, have been developed to permit the used to modify and fine tune the flight properties. Unfortunately, these boomerangs are easily knocked out of adjustment by contact with the ground, hazards such as trees or even during catching the boomerang. The need for extensive readjustment between flights is clearly undesirable.

Traditional boomerangs are made from wood or, today, from rigid plastic materials. These are difficult to catch safely and are particularly dangerous to children and bystanders. Attempts have been made to pad the boomerang with soft material or use soft leading edges as described by Adler in U.S. Pat. Nos. 4,222,573 and 4,479,655. While initially safer and more easily used, these boomerangs suffer from impaired flight characteristics where the covering becomes deformed and are dangerous where the covering is damaged, exposing the rigid inner structure.

The size, weight and rigidity of prior boomerangs generally prevented their use by small children indoors, because of the danger to home furnishings and to the users.

Thus, there is a continuing need for improvements in boomerang toys to overcome the problems noted above, to improve flight and return characteristics and to improve safety and permit safe use by children and indoors.

SUMMARY OF THE INVENTION

It is, therefore, an object of this invention to provide a boomerang toy overcoming the above-noted problems. Another object is to provide a safe, lightweight boomerang toy. A further object is to provide a boomerang toy suitable for safe use indoors. Yet another object is to provide a boomerang toy of improved flight and return attributes.

The above objects, and others, are basically achieved by a boomerang toy having a plurality of blades of unique configuration extending from a central circular hub. The blades and hub are basically coplanar, although the blades may be twisted or bent as desired and the boomerang may be dished out of the original plane. Each blade has a substantially straight or uniformly curved leading edged and a scalloped trailing edge. The trailing edge of each blade decreases in thickness from a reference line extending from the center of the blade toward the trailing edge tip at a shallow angle to the blade centerline. The trailing edge of each blade has a series of three contiguous partial-circle scallops extending from near the blade hub to near the blade tip.

For maximum safety, flexibility and resistance to damage if thrown against a hard object, and to permit safe indoor use, the boomerang is preferably formed from a suitable closed cell foamed synthetic resin or rubber material, which may be a thermoplastic or thermosetting material. Typical materials include foamed polyethylene, polyurethane, neoprene, buna-N nitrile, butyl, and silicone resins or mixtures and copolymers thereof. Optimum performance is attained with cross linked polyethylne as for example, VOLARA, VOLEXTRA and MINICEL - Cross linked, which are, therefore, preferred. Any suitable material may be incorporated into the foam to improve specific properties, such as colorants, surfactants and reinforcements such as chopped fibers, fiber fabrics, fiber matts and mixtures and combinations thereof. Typical reinforcing fibers include glass, graphite and Kevlar aramid fibers and mixtures thereof.

The boomerang toy of this invention may be manufactured by any suitable method. For example, a closed mold having the desired configuration can have foamable material placed or injected therein, after which the material is foamed and cured or cooled to the final state. Typically, the foaming action can result from a heat activated gas generating ingredient, from a gas mixed into a liquid precursor, or any other suitable method. This method is particularly suitable for use with thermosetting resins. Alternatively, the boomerang shape can be cut or punched from flat sheets of foamed material having the desired. Typically, a the material is then hot pressed to form the decreasing thickness along the trailing edge, as described above. The scallops can be formed when the over all shape is produced, or can be cut or punched before or after the hot pressing step. This method of reforming a sheet material is particularly suited for use with thermoplastic materials.

For best results, the radius of the boomerang should be between about 3 and 16 inches, with optimum results at about 5.265 inches. Preferably the weight of such a boomerang will be in the about 4 to 6 gram range, with the optimum weight of the five blade embodiment at about 5.3 grams. The boomerang may have any suitable thickness. Preferably, the thickness will be from about 0.2 to 0.75 inch, with best results at about 0.25 inch. The foam preferably has a density of about 2 to 6 lb/ft$^3$, with optimum at about 3 lb/ft$^3$.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
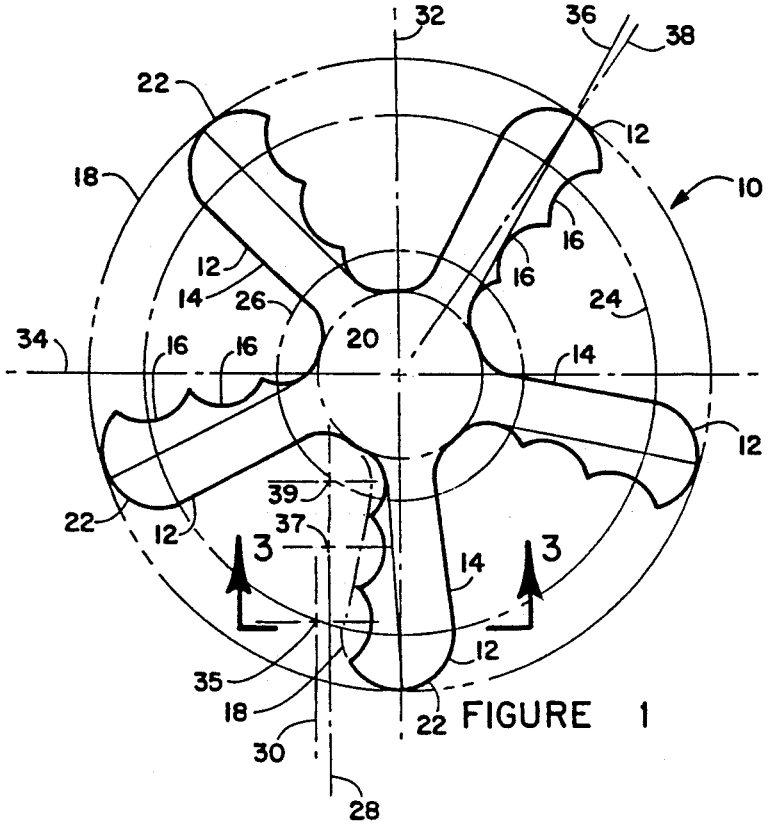
FIG. 1 is a plan view of a first embodiment of the boomerang toy having five straight blades.

Referring now to FIG. 1, there is seen a plan view of an embodiment of the boomerang toy 10 having five generally straight blades 12 extending from a generally circular hub 13. Blades 10 have a substantially straight leading edge 14 and a trailing edge having three contiguous scallops 16. Broken line 18 schematically indicates the shape of the trailing edge without scallops 16, showing that the basic blade is uniform about its centerline.

Certain dimensional relationships among hub 13, blades 12 and scallops 16 are significant in obtaining optimum performance. Since these relationships are normally directly proportional, the radii and lengths shown in FIG. 1 for an optimum embodiment are provided in "length units". For example, if the radius of the boomerang to line 18 is 5.265 length units and the radius of hub 20 is 1.335 length units, then at a length unit of 1 inch, the boomerang will have a radius of 5.265 inches and a hub radius of 1.335 inches, while if the selected length unit of 0.5 inch, the boomerang and hub radii will be 2.633 and 0.668 inch, respectively. Thus, by selecting the actual length of a length unit, the boomerang can be easily scaled to larger or smaller sizes. Optimum overall performance has been obtained with a length unit of 1 inch, resulting in a boomerang with a 10.530 inch diameter.

The tip 22 of each blade 12 is preferably uniformly curved, with any suitable radius. The radius is in the range of 0.940 to 0.990 inch length units with the optimum radius found to be about of 0.965 length units, taken from a circle 24 about the center of hub 20 having a radius in the range of 3.225 to 4.375 length units with an optimum radius of 4.300 length units.

The leading edge 14 of each blade is preferably straight over most of its length, blending into the curved tip 22 and into a curve at the hub 20 typically having a radius of from about 0.79 to 0.59 length units. The optimum curve at the hub has a radius of 0.688 length units, taken from a centerpoint midway between adjacent blades on a circle 26 having a radius of about 2.4 to 1.76 length units and an optimum radius of 2.023 length units.

Scallops may have any suitable shape and depth. For best results, scallops 16 are preferably laid out relative to a first layout line 28 and a second layout line 30, both parallel to a first centerline 32 through the blade 12 being laid out (the lowermost blade in FIG. 1), with first layout line 28 is spaced in the range of 1.38 to 1.03 length units (optimally 1.185 length units from first centerline 32 and the second layout line 30 spaced from 1.64 to 1.24 length units (optimally 1.425 length units) from first centerline 32. The centers of the radii forming the scallops lie along a layout line a specific distance from second centerline 34 perpendicular to first centerline 32. The outermost scallop 16 has a radius in the range of 4.69 to 3.54 with an optimum radius of 0.875 length units, with the centerpoint 35 on second layout line 30, in the range of 4.69 to 3.54 (optimally 4.075 length units) from said second centerline 34. The second, or central, scallop 16 has an optimum radius in the range of 0.92 to 0.70 length units with an optimum radius of 0.800 length units, with the centerpoint at 37 on first layout line 28, typically in the range of about 3.16 to 2.39 length units (optimally 2.750 length units) from second centerline 34. The innermost scallop 16 has an optimum radius of about 0.750 length units, with the centerpoint at 39 on said first layout line 28, of about 2.02 to 1.53 length units (optimally 1.756 length units) from second centerline 34.

The blades 12 taper in thickness from a reference line 36 that extends from the blade tip and lies at an angle of from about 9 to 6° 42′ to a third centerline 38. Reference line preferably lies at an optimum angle of 7° 46′ to third centerline 38, substantially aligned with the center of the blade 12. Thus, the area of decreasing thickness is skewed towards the tip end of each trailing edge.

Figure 2:
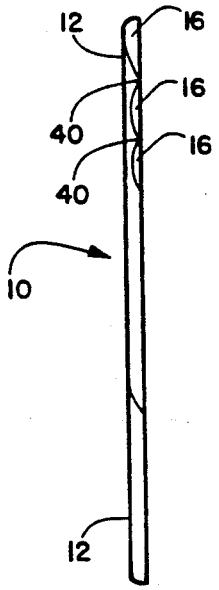
FIG. 2 is an elevation view of the embodiment of FIG. 1.

FIG. 2 is an elevation view showing boomerang 10, taken from the right side of FIG. 1. The optimum thickness of the boomerang is 0.250 length units, as indicated. Scallops 16 are cut or otherwise formed into the decreasing thickness region of blade 12. Thus, the points 40 between adjacent scallops 16 will have an inherent lesser thickness than the centers of the scallops.

Figure 3:
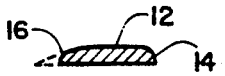
FIG. 3 is a section view taken on line 3—3 in FIG. 1.

FIG. 3 is a section view taken through a blade 12 on line 3—3 in FIG. 1. The blade has an optimum thickness of 0.250 length units, while the leading edge has an optimum radius of 0.188 length units, running from a substantially square edge at the lower surface upward to blend into the upper surface. The center of each scallop 16 may have a radius varying along the scallop or may have a square edge if the scallops are cut from the blade.

With these relationships in mind, a boomerang having the correct proportions may be laid out having any suitable over all diameter.

Figure 4:
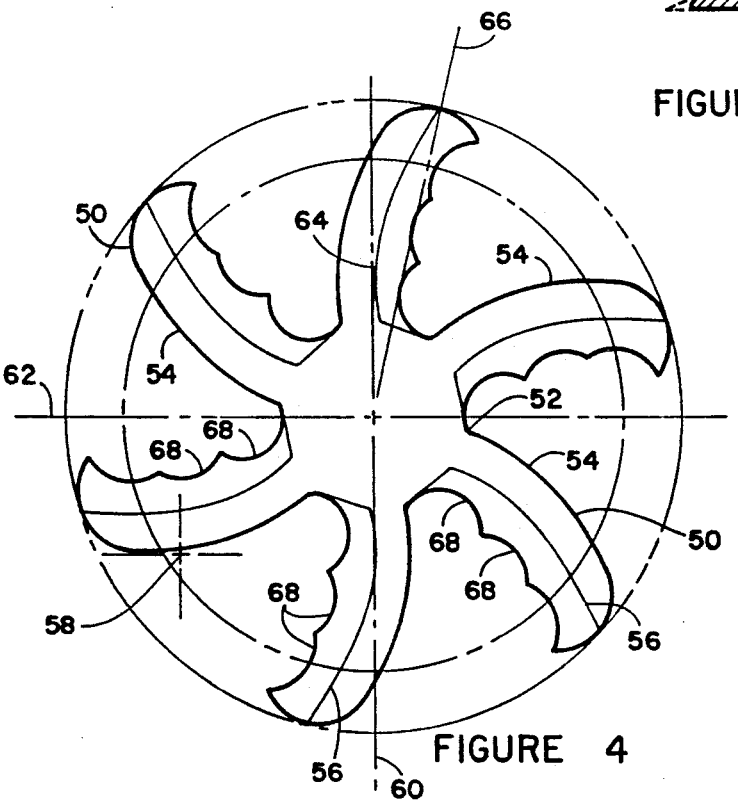
FIG. 4 is a plan view of a second embodiment of the boomerang toy having six curved blades.

FIG. 4 illustrates a second embodiment of the boomerang toy, having curved rather than straight blades, seen in plan view. In this case, six curved blades 50 are uniformly spaced around hub 52. The overall boomerang of this embodiment has a radius of from about 6.05 to 4.58 length units and has an optimum radius of 5.265 length units, the same as in the embodiment of FIG. 1–3. The leading edge 54 of each blade 50 has a radius of about 4.60 to 3.48 length units and an optimum radius of 4.000 length units and each blade centerline 56 has a radius of about 3.85 to 2.19 length units and with an optimum radius of 3.350 length units, both taken from a centerpoint 58, located relative to vertical centerline 60 and horizontal centerline 62 in the manner discussed relative to FIG. 1. These radii may be varied, where suitable.

Vertical centerline 60 is tangential to blade centerline 56 at point 64, near hub 52. A reference line 66 is plotted from the hub center at a suitable angle. Optimum results are obtained with a range of 15 to 11 degrees. Optimum results are obtained with an angle of 13° 5′ to vertical centerline 60. The thickness of each blade 50 tapers in thickness toward the scalloped trailing edge from reference line 66. As can be seen, the tapered area is greatest toward the tip of each blade, in a manner similar to the taper provided in the embodiment of FIG. 1.

The centerpoints of the three scallops 68 are located relative to vertical centerline 60 and horizontal centerline 62 in the manner described above. The optimum radii of the outer, central and inner scallops are 0.875, 0.800 and 0.750 length units, respectively, the same as the scallops shown in FIG. 1.

Figure 5:
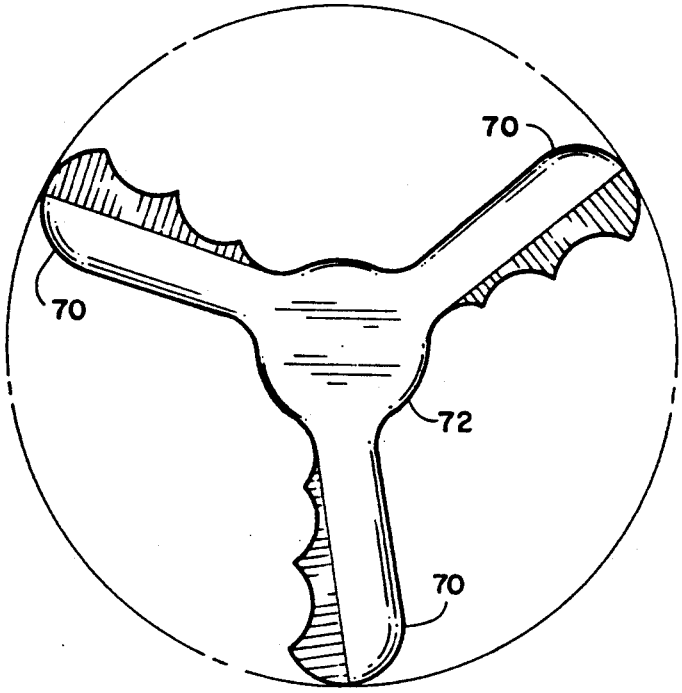
FIG. 5 is a plan view of a third embodiment of the boomerang toy, having three blades of the sort shown in FIG. 1.

A three-bladed variation of the embodiment of FIG. 1 is shown in FIG. 5. Blades 70 are uniformly spaced around hub 72. Each blade 70 is substantially identical to those shown in FIG. 1, the only difference being the blade number and spacing. Each blade shape, proportions and scallop configuration is laid out as described in conjunction with the description of FIG. 1.

Figure 6:
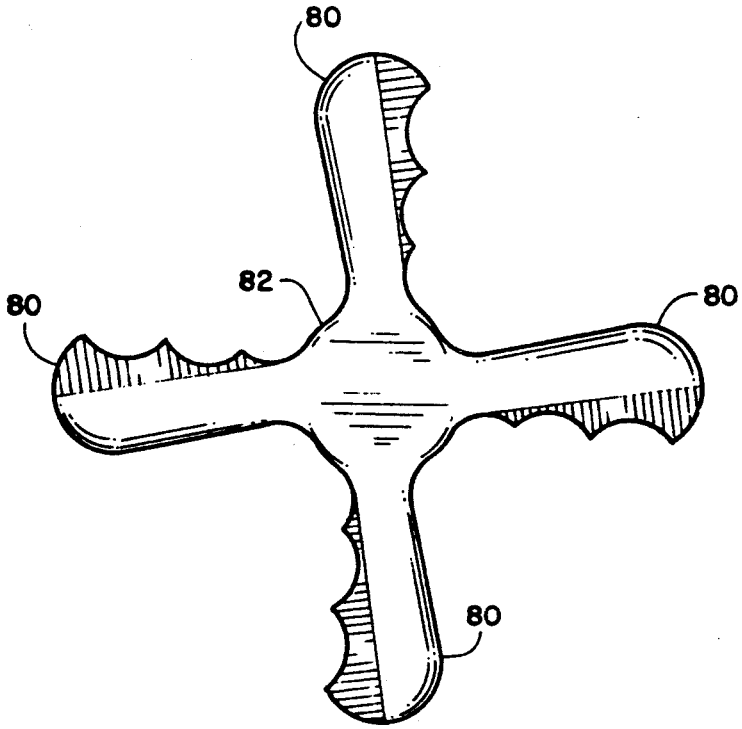
FIG. 6 is a plan view of a third embodiment of the boomerang toy, having four blades of the sort shown in FIG. 1.

A four bladed variation of the embodiment of FIG. 1 is illustrated in plan view in FIG. 6. Blades 70 are again uniformly spaced around hub 82. All relative dimensions are the same as with the embodiment of FIG. 1. Each individual blade is identical with those shown in FIG. 1, with the blade and scallop configurations laid out as described above. The embodiment of FIG. 4 may also be produced in 3 to 6 bladed versions.

While certain preferred and optimum materials, dimensions and configurations have been detailed in the above description of preferred embodiments, those can be varied, where suitable, with similar results. For example, while a uniform spacing of blades around the hub produces the best results, a slightly irregular spacing may be used, if desired. Use of from 3 to 6 blades produces the best flight characteristics. Additional blades may be used, although a great number of blades is undesirable and will tend to make the boomerang fly more like a flying disk than a boomerang.

Other applications, variations and ramifications of this invention will occur to those skilled in the art upon reading this disclosure. Those are intended to be included within the scope of this invention, as defined in the appended claims.

I claim:

1. A light weight and safe boomerang toy having improved flight and return characteristics which comprises:

a generally planar, circular, hub portion;

from 3 to 6 substantially uniformly spaced blades extending outwardly from said hub and substantially coplanar therewith;

each of said blades having a continuous, uniformly shaped, leading edge;

each of said blades having a trailing edge having three contiguous inwardly directed scallops extending over substantially the entire trailing edge;

each of said blades and said hub being substantially coplanar;

each of said blades and said hub having a substantially uniform thickness, except that the trailing portion of each blade decreases substantially in thickness from a reference line near the blade centerline to the trailing edge; and said reference line angled from the center of the blade tip toward the blade trailing edge.

2. The boomerang toy according to claim 1 wherein the greater length of the leading edge of each blade is a substantially straight line.

3. The boomerang toy according to claim 1 wherein the greater length of the leading edge of each blade is a generally circular curve.

4. The boomerang toy according to claim 1 wherein each blade tip has a radius of about 0.94 to 0.99) length units.

5. The boomerang toy according to claim 1 wherein the leading edge of each blade blends into the outer edge of said hub along a line having a radius of about 0.790 to 0.590 length units and a center lying on a circle of about 2.4 to 1.76 length unit radius about the center of said hub.

6. The boomerang toy according to claim 1 wherein said boomerang toy is formed from a soft but shape retaining synthetic resin closed cell foam material.

7. The boomerang toy according to claim 6 wherein said synthetic resin is selected from the group consisting of polyethylene, polyurethane, neoprene, buna-N nitrile, butyl, silicone, and mixtures and copolymers thereof.

8. The boomerang toy according to claim 6 wherein said foam includes reinforcements selected from the group consisting of chopped fibers, fiber fabrics, fiber matts and mixtures and combinations thereof.

9. The boomerang toy according to claim 1 wherein the weight of the boomerang is from about 4 to 6 grams and a density of from about 2 to 6 lb/ft$^3$.

10. A light weight and safe boomerang toy having improved flight and return characteristics which comprises:

a generally planar, circular, hub portion having a radius of about 1.53 to 1.16 length units, from 3 to 6 substantially uniformly spaced blades extending outwardly from said hub and substantially coplanar therewith;

said blades each having a centerline passing through the hub center and the approximate center of the blade, each blade having a tip lying along a circle having a radius of about 6.05 to 4.58 length units;

each blade being substantially uniform in thickness, except that the trailing edge of each blade decreases substantially uniformly in thickness away from a reference line that intersects the blade centerline at the blade tip edge and extends at an angle of from about 9 degrees to 6 degrees 42 minutes toward said trailing edge; and the trailing edges of said blades each having three contiguous inwardly directed scallops.

11. The boomerang toy according to claim 10 wherein said hub and blades have a substantially planar lower surface and the leading edge of each blade has a radius of from about 0.22 to 0.16 length units, said radius taken from a centerpoint lying along the lower surface of said blade.

12. The boomerang toy according to claim 10 wherein said hub and untapered areas of said blades have a substantially uniform thickness of from about 0.29 to 0.22 length units.

13. The boomerang toy according to claim 10 wherein the first, innermost, scallop has a radius of about 0.86 to 0.65 length units with the radius taken from a centerpoint lying on a first layout line parallel to the blade centerline and spaced about 1.38 to 1.03 length units to the trailing edge side of the centerline and about 2.02 to 1.53 length units along said first layout line from the intersection of the first layout line and a line perpendicular to the first layout line that passes through the hub centerpoint.

14. The boomerang toy according to claim 10 wherein the second, central, scallop has a radius of about 0.92 to 0.70 length units with the radius taken from a centerpoint lying on said first layout and located about 3.16 to 2.39 length units along said first layout line from the intersection of the first layout line and a line perpendicular to the first layout line that passes through the hub centerpoint.

15. The boomerang toy according to claim 10 wherein the third, outermost, scallop has a radius of about 1.01 to 0.76 length units, with the radius taken from a centerpoint lying on a second layout line parallel to the blade centerline and spaced about 1.64 to 1.24 length units to the trailing side of the centerline and about 4.69 to 3.54 length units along said second layout line from the intersection of the second layout line and a line perpendicular to the second layout line that passes through the hub centerpoint.

16. The boomerang toy according to claim 10 wherein each blade tip has a radius of about 1.11 to 0.839 length units.

17. The boomerang toy according to claim 10 wherein the leading edge of each blade blends into the outer edge of said hub along a line having a radius of about 0.79 to 0.60 length units and a center lying on a circle of about 2.34 to 1.76 radius about the center of said hub.

18. The boomerang toy according to claim 10 wherein said boomerang toy is formed from a soft synthetic resin closed cell foam material.

19. The boomerang toy according to claim 18 wherein said synthetic resin is selected from the group consisting of polyethylene, polyurethane, neoprene, buna-N nitrile, butyl, silicone, and mixtures and copolymers thereof.

20. The boomerang toy according to claim 18 wherein said foam includes reinforcements selected from the group consisting of chopped fibers, fiber fabrics, fiber matts and mixtures and combinations thereof.

21. The boomerang toy according to claim 10 wherein the weight of the boomerang is from about 4 to 6 grams and a density of from about 2 to 6 $lb/ft^3$.

* * * * *